US007416453B2

(12) United States Patent
Germani

(10) Patent No.: US 7,416,453 B2
(45) Date of Patent: Aug. 26, 2008

(54) ELECTRICAL CONNECTOR ELEMENT FOR CONDUCTORS WITH CRIMPED CONTACTS

(75) Inventor: Emilio Germani, Legnano (IT)

(73) Assignee: Industria Lombarda Materiale Elettrico I.L.M.E. S.p.A., Milan (IT)

( * ) Notice: Subject to any disclaimer, the term of this patent is extended or adjusted under 35 U.S.C. 154(b) by 86 days.

(21) Appl. No.: 11/368,673

(22) Filed: Mar. 7, 2006

(65) Prior Publication Data

US 2006/0199441 A1 Sep. 7, 2006

(30) Foreign Application Priority Data

Mar. 7, 2005 (IT) ..... MI2005A0347

(51) Int. Cl.
*H01R 13/514* (2006.01)

(52) U.S. Cl. ..... 439/752

(58) Field of Classification Search ..... 439/752, 439/595

See application file for complete search history.

(56) References Cited

U.S. PATENT DOCUMENTS 4,544,220 A * 10/1985 Aiello et al. ..... 439/594
4,596,436 A * 6/1986 Kraemer et al. ..... 439/701
4,749,373 A * 6/1988 Brekosky et al. ..... 439/595
5,002,504 A * 3/1991 Carlson ..... 439/599
5,445,541 A * 8/1995 May et al. ..... 439/595
5,554,051 A * 9/1996 Shinji et al. ..... 439/595
5,643,009 A * 7/1997 Dinkel et al. ..... 439/595
5,730,624 A * 3/1998 Lester et al. ..... 439/595
6,358,102 B1 * 3/2002 Fukamachi ..... 439/752
6,764,334 B2 * 7/2004 Tsuji et al. ..... 439/595
6,764,351 B2 * 7/2004 Finzer et al. ..... 439/752
6,945,829 B2 * 9/2005 Finzer et al. ..... 439/752
6,951,484 B2 * 10/2005 Tsuji ..... 439/595

* cited by examiner

*Primary Examiner*—Gary F. Paumen
(74) *Attorney, Agent, or Firm*—Young & Thompson

(57) ABSTRACT

An electrical connector element (1) includes a connector body (2) wherein contact housings (20) are formed, electrical contacts (4) crimped to respective electrical cables (8) and able to be housed in the contact housings (20) of the connector body (2) and locking elements (5) designed to be fixed in the connector body (2) after insertion of the contacts (4). The locking elements (5) include stops (55), which protrude into the contact housings (20) so as to prevent the contacts (4) from coming out of their housings.

14 Claims, 5 Drawing Sheets

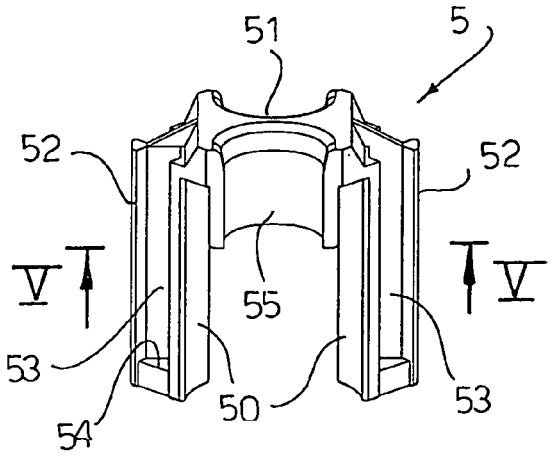
FIG. 2
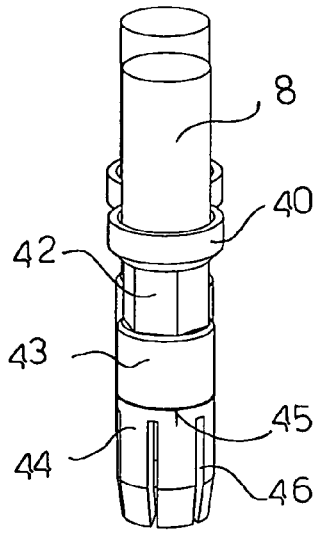
FIG. 1
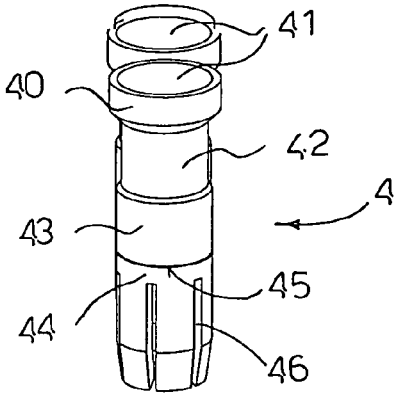
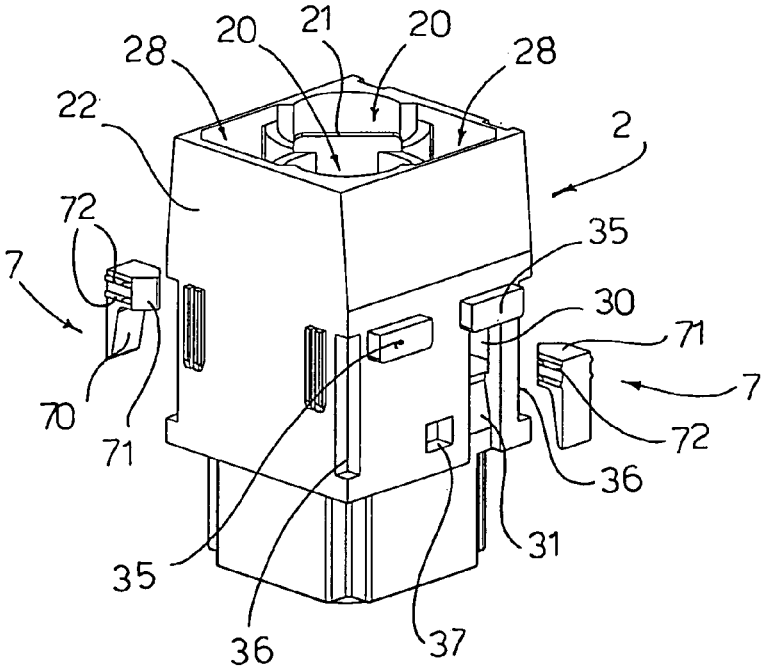

ELECTRICAL CONNECTOR ELEMENT FOR CONDUCTORS WITH CRIMPED CONTACTS

BACKGROUND OF THE INVENTION

1. Field of the Invention

The present invention refers to an electrical connector element for conductors with crimped contacts.

2. Description of the Related Art

As is known, electrical connectors are generally composed of a pair of connector elements. Each connector element comprises an insulated body (commonly known as connector body) wherein are mounted the respective contacts (male and female) which are connected to electrical cables with one of the various connection technologies available, such as screw, spring, insulation piercing and crimping.

In crimping connection technology, the top portion of the contact is crimped, by means of an appropriate crimping tool, to the end of the wires of the electrical cable, so as to form an optimal electrical contact. Crimping is the preferred connection technology in professional and military applications, where the connection must stand up to strong mechanical stresses (impacts and vibrations) and to aggressive atmospheres. Once the contact has been crimped with the electrical cable, it is inserted into its housing in the connector body.

Therefore, for connectors with crimped contacts, a factor of particular importance is retention of the contacts in the connector body during coupling with the other electrical connector element and in the event of stresses (tractions and/or rotations) on the cables, which are transmitted to the contacts.

In the connector elements of the prior art, locking of crimped contacts takes place by means of a spring (generally of steel or of plastic) disposed inside the connector body. Said spring is elastically deformed during insertion of the contact and then it returns to its original shape, retaining the contact in its housing. Said contact locking system presents some drawbacks:

Variation in the elasticity of the spring is related to the tolerances of the materials and of the manufacturing processes.

In order to be able to remove the contacts from the connector body a particular extractor tool is necessary which, once inserted in the housing of the contact, compresses the spring by a sufficient amount to allow extraction of the contact.

To be able to retain the contacts firmly in their housings, springs whose strength and stiffness increases as the dimensions of the spring increase are necessary. Thus, in the case of large-sized contacts, it is necessary to oversize the spring and to apply greater stresses thereto for release (extraction) of the contacts. As a result insulating connector bodies with a greater mechanical strength must be made, to avoid breakage thereof during operation of the extractor tool.

SUMMARY OF THE INVENTION

The object of the present invention is to eliminate the drawbacks of the prior art, providing an electrical connector element for conductors with crimped contacts, which ensures an efficient, effective and safe locking system for the contacts.

Another object of the present invention is to provide such an electrical connector element for conductors with crimped contacts that is cheap, easy to make and easy to assemble.

These objects are achieved in accordance with the invention to provide an electrical connector element (1) that includes a connector body (2) wherein contact housings (20) are formed, electrical contacts (4) crimped to respective electrical cables (8) and adapted to be accommodated in said contact housings (20) of the connector body (2), and locking means (5) adapted to be fixed to said connector body (2) after insertion of the contacts (4), said locking means (5) comprising stops (55) which protrude into said contact housings (20) so as to prevent said contacts (4) from coming out of their seats.

Advantageous embodiments of the invention are apparent from the dependent claims. The electrical connector element according to the invention comprises a connector body wherein are formed contact housings adapted to house electrical contacts crimped to respective electrical cables. The main characteristic of the invention is represented by the fact that said connector element comprises locking means adapted to be fixed in said connector body, after insertion of the contacts. The locking means comprise stops, which protrude into the contact housings so as to prevent the contacts from coming out of their seats.

Said locking means allow the use of the contact-locking springs, and thus all the drawbacks related to said springs, to be eliminated.

BRIEF DESCRIPTION OF THE DRAWING FIGURES

Further characteristics of the invention are made clearer by the detailed description that follows, referring to a purely exemplifying and therefore non-limiting embodiment thereof, illustrated in the appended drawings, in which:

FIG. 1 is a perspective view of a connector element according to the invention, illustrating in an exploded view a locking element, two female contacts destined to be crimped to an electrical cable, a connector body and two locking keys;

FIG. 2 is a perspective view, illustrating the female contacts of FIG. 1 crimped on the electrical cables;

DETAILED DESCRIPTION OF THE PREFERRED EMBODIMENTS

Figure 3:
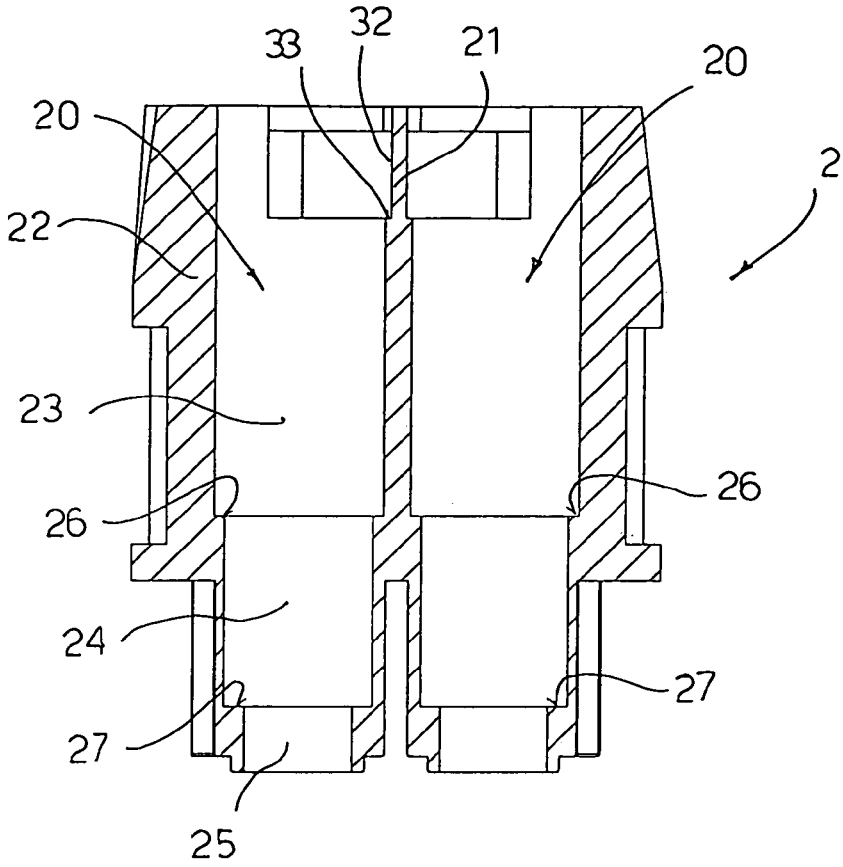
FIGS. 3 and 4 are two sectional views of the connector body taken along planes passing through the respective diagonals of the connector body.

The connector element according to the invention, denoted as a whole with reference numeral 1, is described with the aid of the Figures. As shown in FIG. 1, the connector element 1 comprises:

an insulating connector body 2, two electrical contacts 4 destined to be housed in the connector body 2, a locking element 5 adapted to lock the electrical contacts 4 inside the connector body 2 and two locking keys 7 adapted to lock the locking element 5 inside the connector body 2.

Each electrical contact 4 is made of a conductive metal material, is substantially cylindrical in shape and has at one end a top collar 40 which defines a housing 41 adapted to accommodate the wires of an electrical conductor cable 8 (FIG. 2).

Beneath the collar 40 of the contact 4 there is defined a cylindrical crimping portion 42, which is crimped with a suitable crimping tool, so as to lock the wires of the conducting cable 8 inside the seat 41 of the contact.

Beneath the crimping portion 42 there extends an intermediate collar 43 with a larger diameter beneath which a cylindrical portion 44 with a smaller diameter extends, which defines the contact proper. In this manner an annular abutment surface 45 is defined between the intermediate collar 43 and the proper contact portion 44.

In the Figures a female contact 4 has been illustrated by way of example. Thus, the cylindrical portion 44 is hollow on the inside and open at its end to be able to receive therein a male contact. For this purpose longitudinal slots 46 are formed in the cylindrical portion 44 which allow elastic yielding of the cylindrical portion 44, when it receives the male contact therein.

For greater clarity, a connector element 1 with contacts 4 without an electrical cable 8 will be illustrated in the Figures; however, it is obvious that the contacts 4 must be crimped to the cable 8 before being assembled in the connector element 1. Furthermore, even if a connector element with female contacts 4 has been illustrated in the Figures, it is obvious that the invention also extends to connector elements with male contacts.

The connector body 2 comprises a body 22 taking the form of a parallelepiped block substantially square in cross section. The bottom part of the connector body is smaller in size and is the coupling portion, which is of such a shape as to be able to couple, in a per se known manner, with a complementary coupling portion of another connector element.

As shown better in FIG. 3, two substantially cylindrical housings 20 are formed in the connector body 2, destined to accommodate the contacts 4.

In the Figures, by way of example the axes of the housings 20 lie on a plane passing through a diagonal of the body 22 of the connector body and the housings 20 are separated from each other by a partition 21 lying on the plane passing through the other diagonal of the body 22. However, the housings 20 can differ in number and can be disposed differently.

Each seat 20 is made like a through channel consisting of a first hole 23 with a larger diameter, a second hole 24 with a smaller diameter than the first one and a third hole 25 with a smaller diameter than the second one. In this manner a first annular abutment surface 26 is defined between the first hole 23 and the second hole 24 and a second annular abutment surface 27 is defined between the second hole 24 and the third hole 25.

A widening 32, which extends for about 180° in order to give rise to a semicircular abutment surface, is formed in the top part of the first-hole 23.

The contacts 4 are disposed in the respective housings 20 of the connector body, so that the annular abutment surface 45 of the intermediate collar 43 of each contact 4 abuts against the first abutment surface 26 of the respective seat 20, preventing axial movement downward (with reference to the Figures) of the contact 4. In this situation, the bottom end of the cylindrical portion 44 of the contact proper is tightly close to the second abutment surface 27 of the housing 20.

Figure 4:
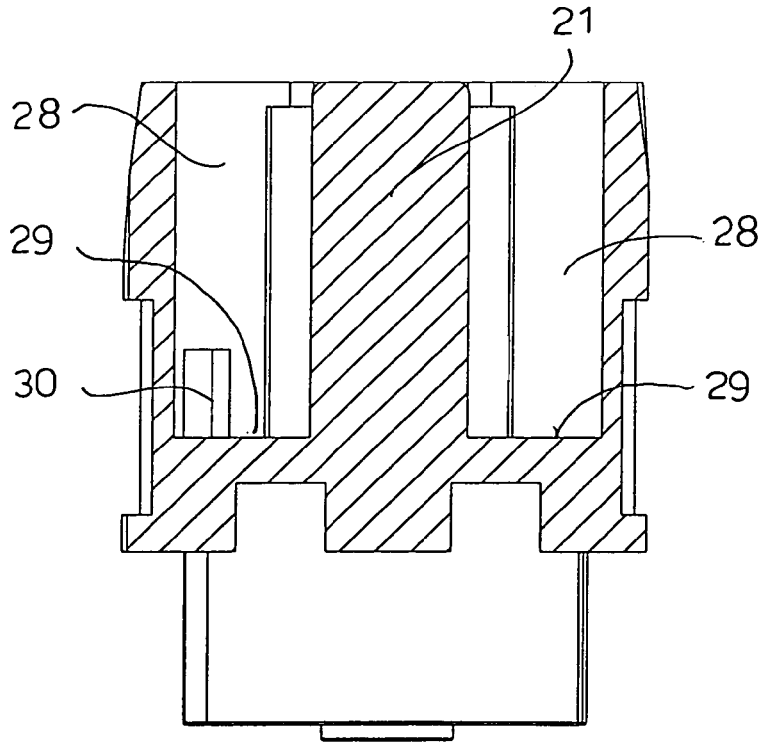

As shown also in FIG. 4, inside the body 22 are formed two further seats 28 disposed near the two corners of the body on one side and on the other with respect to the contact housings 20. The seats 28 are substantially triangular shaped in cross section, are upwardly open and end in a bottom abutment wall 29.

Two rectangular slots 30 (only one visible in FIGS. 1 and 4) which communicate with the respective seats 28 are formed in the side wall of the body 22. Beneath each slot 30 a tapered entry guide 31 formed in the outer side surface of the body 22 is defined.

Each slot 30 of the body of the connector body is designed to be engaged by a substantially L-shaped locking key 7 (FIG. 1). The locking key 7 comprises a tapered surface 70 destined to cooperate with the tapered surface 31 of the wall of the body 22 of the connector body. Furthermore the key 7 has a protruding tooth 71, which engages in the slot 30 of the wall of the body of the connector body. Outwardly protruding ribs 72 are provided on the side walls of the key 7 to allow an engagement with a certain interference in the slot 30.

In order to keep the contacts 4 locked in the housings 20 of the connector body, a locking element 5 in the form of a bridge consisting of two supporting legs 50 connected to a top joining element 51 is used. The locking element 5 can be made in a single piece by injection moulding of plastic materials.

Each leg 50 is substantially triangular in cross section and of such a size as to be able to be inserted in the respective seats 28 formed in the body of the connector body 2. For this purpose, the corners of the seats 28 are chamfered and each leg 50 also has a chamfered edge 52. In this manner, when the legs 50 of the locking element are inserted in their seats 28 in the connector body, the edges 52 of the legs slide in a guided manner on the corners of the seats 28 of the connector body.

Figure 5:
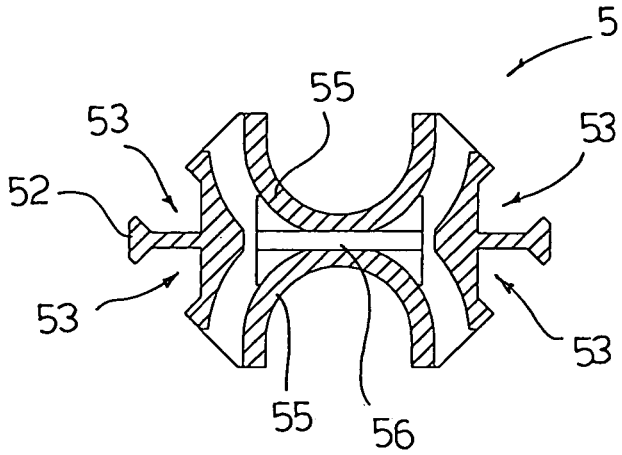
FIG. 5 is a sectional view of the locking element taken along the plane of section V-V of FIG. 1.

As shown also in FIG. 5, each leg has two longitudinal seats 53 (only one visible in FIG. 1) ending in a bottom abutment surface 54.

The top joining element 51 of the locking element 5 is substantially X-shaped in plan view and has two semi-cylindrical stops 55 (only one visible in FIG. 1). As shown in FIG. 5, the two semi-cylindrical stops 55 are disposed like two Cs with the concave parts facing outwards and the convex parts spaced apart from each other by a space 56 sufficient to allow the passage of the intermediate partition 21, which separates the two contact housings.

Figure 6:
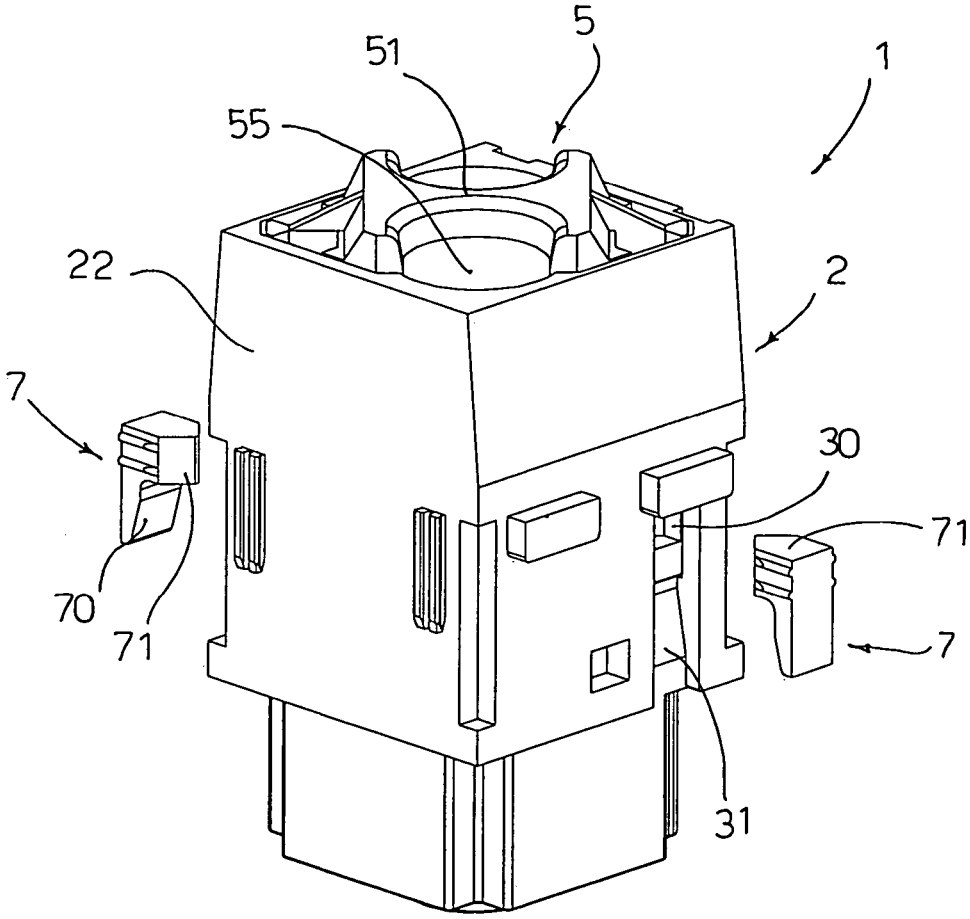
FIG. 6 is a perspective view illustrating the electrical connector element of FIG. 1 assembled, but with the locking key again in an exploded view.

Each semi-cylindrical stop 55 of the locking device is of such a size as to be able to be housed in the widening 32 of each contact housing 20. Then, after the contacts 4 have been inserted in their housings 20 in the connector body, the locking element 5 also is inserted in the connector body 2, as shown in FIG. 6. That is, the legs 50 of the locking element 5 are inserted into the corner seats 28 of the connector body, until the base of the legs 50 abuts against the abutment surface 29 (FIG. 4) of the seats 28 of the connector body.

In this situation the semi-cylindrical stops 55 of the locking element are housed in the widenings 32 of the contact housings 20, the bottom ends of the semi-cylindrical stops 55 of the locking element abut against the top end of the collar 40 of the contacts and the partition 21 between the two housings 20 of the contacts is disposed between the two stops 55.

Figure 7:
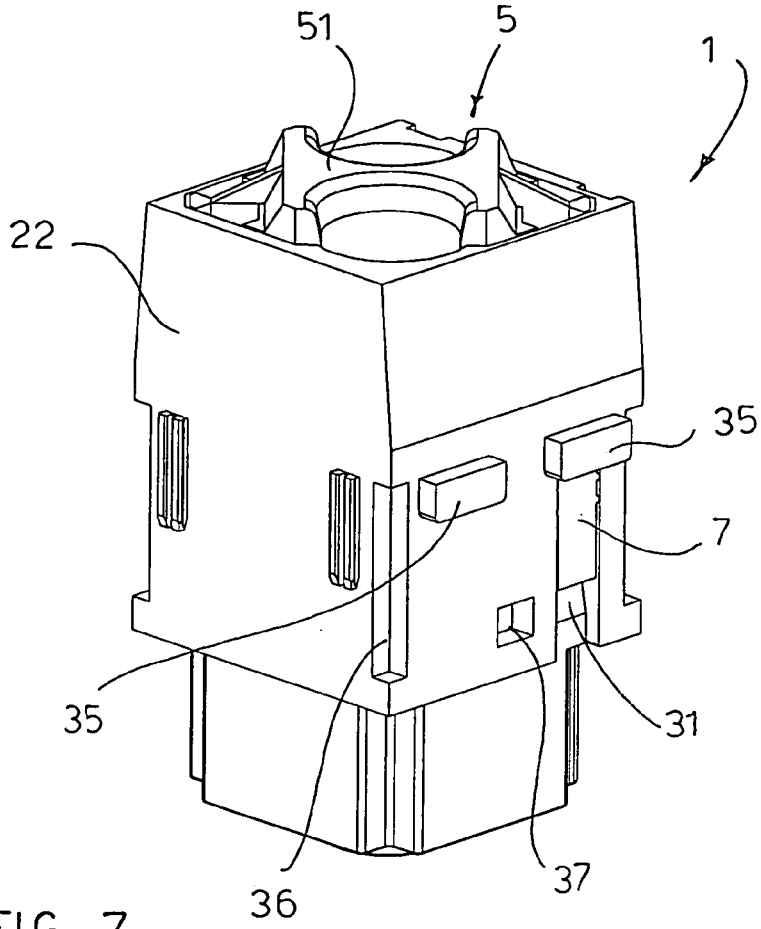
FIG. 7 is a perspective view illustrating the electrical connector element of FIG. 6, in which the locking keys have been assembled.
Figure 8:
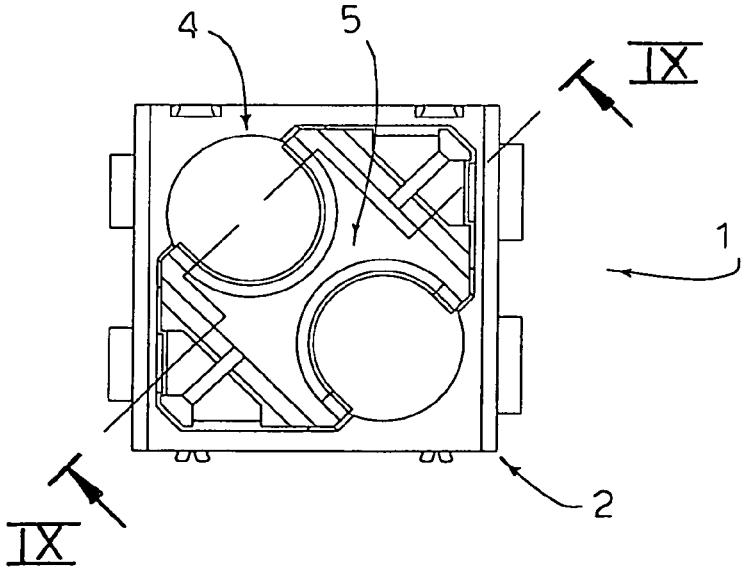
FIG. 8 is a top plan view of the assembled connector element of FIG. 7.

At this point, in order to lock the locking element 5 inside the connector body 2, as shown in FIG. 7, the keys 7 are inserted in the respective slots 30 of the side wall of the connector body. In this operation the tapered surface 70 of the key 7 abuts against the tapered surface 31 of the wall of the body 22 of the connector body beneath the slot 30 and the ribs 72 of the key 7 ensure insertion with a certain forcing of the protruding part 71 of the key in the slot 30 of the connector body.

Furthermore it should be noted that the particular shape of the key 7 and in particular the tapered surface 70 thereof which cooperates with the tapered surface 31 of the wall of the body 22 of the connector body allow easy removal of the key, possibly with the aid of the tip of a screwdriver which levers beneath the end of the key.

Figure 9:
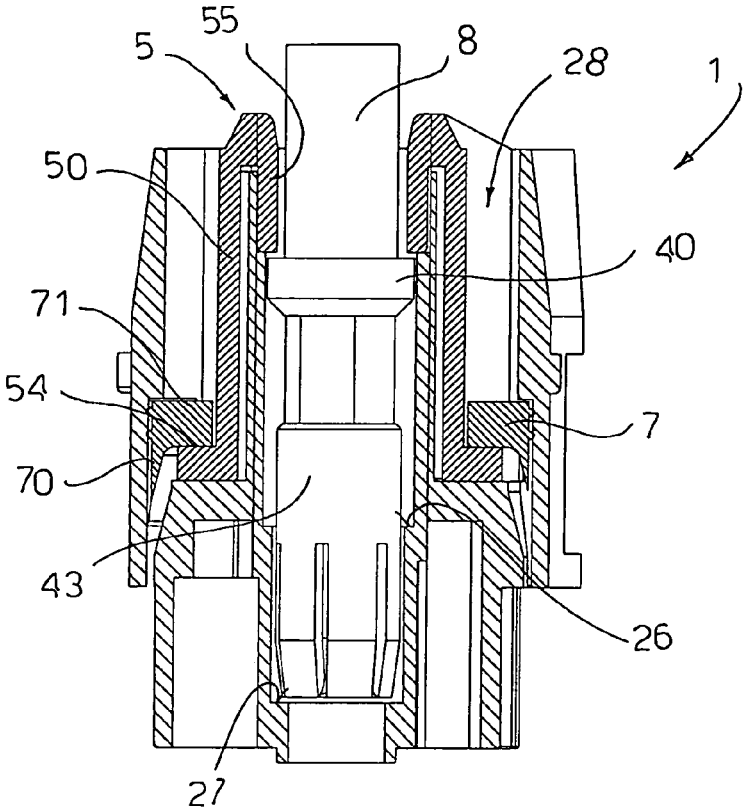
FIG. 9 is a sectional view of the assembled connector element, taken along the line IX-IX' of FIG. 8.

As shown in FIG. 9, the retaining tooth 71 of each key 7 enters the longitudinal seat 53 of the respective leg 50 of the locking element and abuts on the abutment surface 54 of the base of the respective leg 50, thus preventing axial extraction of the locking element 5.

As a result, each contact 4 is locked in its seat 20 and any axial movement thereof is prevented. In fact, the top end of the top collar 40 of the contact will abut against the bottom end of the semi-cylindrical stops 55 of the locking element 5 and the abutment surface 45 of the intermediate collar 43 of each contact 4 will abut against the abutment surface 26 of the intermediate hole 24 of the contact housing 20.

Returning to FIG. 1, four protrusions 35 (two protrusions 35 in each wall) are formed in two opposite side walls of the body 22 of the connector body. The two protrusions 35 of one wall are spaced apart from each other and aligned. One protrusion 35 is situated above the respective slot 30 of the key 7. Furthermore grooves 36 are formed in the edges of the body 22 of the connector body. In each wall of the connector body wherein there are protrusions 35, a slot 37 is provided disposed beneath the protrusions 35 in a median position.

Figure 10:
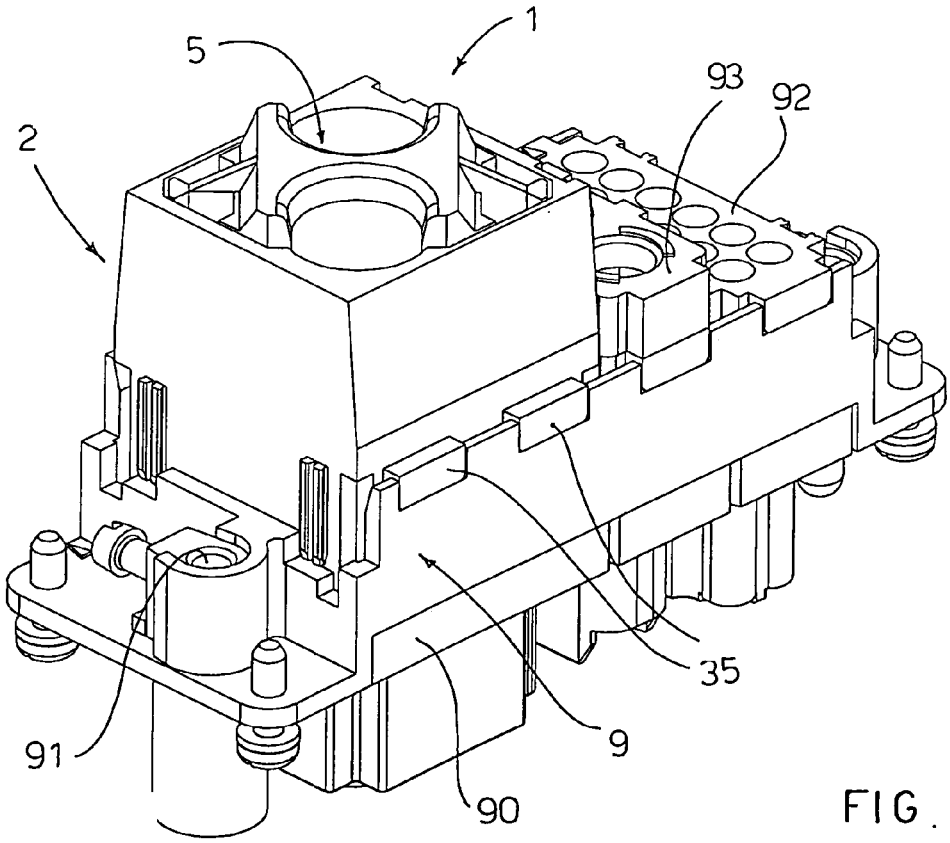
FIG. 10 is a perspective view, showing the connector element of FIG. 7 assembled and mounted in a connector frame.

Such a configuration of the side walls of the connector body 2 serves to apply on the connector body 2 a frame 9, like that illustrated in FIG. 10. The frame 9 is formed by four rectangular metal plates, which surround the middle part of the connector body 2. The frame 9 serves as a seat for the earth contacts 91 and also contains, besides the connector body 2, other connector bodies (in the case illustrated, the connector bodies 92 and 93).

In this manner the top edge of the frame 9 abuts against the protrusions 35 of the connector body 2 and the bottom edge of the frame 9 is locked by means of two keys 90 (only one visible in FIG. 10). Each key 90 has three teeth, which engage in a snap coupling relationship in the two slots 26 in the edges of the body of the connector body and in the intermediate slot 37 in the wall of the body of the connector body.

It should be noted that the walls of the frame 9 compress the keys 7 which lock the locking element 5, thus preventing any possibility of disengagement of said keys 7, even in the case of particularly violent vibrations or impacts.

It must moreover be considered that the stops 55 of the locking element 5 have been configured in a semi-cylindrical shape to be able to rest on a large surface of the upper edge of the contact 4. This solution ensures greater safety with respect to springs of the prior art, which have a small surface that locks the contact. Therefore the connector element 1 ensures that the contact 4 is retained even in the presence of strong traction on the electrical cable.

Even if a connector element with two poles disposed diagonally has been illustrated in the Figures, it is obvious that the present invention also extends to multipolar connector elements in which a plurality of poles disposed side by side in two rows is provided.

Numerous changes and modifications of detail within the reach of a person skilled in the art can be made to the present embodiment of the invention without thereby departing from the scope of the invention as set forth in the appended claims.

The invention claimed is:

1. An electrical connector element (1) comprising:

a connector body (2), wherein contact housings (20) adapted to house electrical contacts (4) are formed, said electrical contacts (4) being crimped to respective electrical cables (8) and adapted to be accommodated in said contact housings (20) of the connector body (2); and locking means (5) adapted to be fixed to said connector body (2) after insertion of the contacts (4) into the contact housings (20), said locking means (5) comprising stop means (55) which protrude into said contact housings (20) so as to prevent said contacts (4) from coming out of their housings (20), wherein said locking means (5) are fixed in said connector body (2) by means of locking keys (7).

2. A connector element according to claim 1, wherein said locking means (5) are removably fixed in said connector body (2).

3. A connector element according to claim 1, wherein the body (22) of said connector body is surrounded by a frame (9), which holds said locking keys (7) firmly in position.

4. An electrical connector element (1) comprising:

a connector body (2) in which contact housings (20) are formed;

electrical contacts (4) crimped to respective electrical cables (8) and adapted to be accommodated in said contact housings (20) of the connector body (2); and locking means (5) adapted to be fixed to said connector body (2) after insertion of the contacts (4), said locking means (5) comprising stop means (55) which protrude into said contact housings (20) so as to prevent said contacts (4) from coming out of their housings (20), wherein said locking means (5) are fixed in said connector body (2) by means of locking keys (7), and said locking key (7) comprises a protrusion (71), which is inserted into a slot (30) in the side wall of the body of the connector body to engage in a seat (53) of said locking means (5).

5. A connector element according to claim 4, wherein each of said locking keys (7) comprises a tapered surface (70) which cooperates with a tapered surface (31) formed on the outer side wall of the body of the connector body, beneath said slot (30) the protrusion (71) of the key is accommodated.

6. A connector element according to claim 4, wherein said locking key (7) comprises side ribs (72) protruding outwardly, to allow interference engagement of the protruding part (71) of the key in the respective slot (30) of the connector body.

7. A connector element according to claim 4, wherein said locking means (5) comprise legs (50) which are inserted into the seats (28) formed in said connector body (2) and separated from the contact housings (20), wherein said legs (50) support said stops (55) which are inserted into said contact housings (20).

8. A connector element according to claim 7, wherein each leg (50) of said locking means (5) comprises at least one seat (53) ending in an abutment surface (54) disposed at the base of the leg and able to abut against said protrusion (71) of the locking key (7).

9. A connector element according to claim 4, wherein said locking means (5) are removably fixed in said connector body (2).

10. A connector element according to claim 4, wherein said stop means (55) of the locking means (5) are substantially semi-cylindrical in shape, so that their bottom end abuts against the edge of the top end of the respective contact (4) disposed in the contact housing (20).

11. An electrical connector element (1) comprising:

a connector body (2), wherein contact housings (20) adapted to house electrical contacts (4) are formed, said electrical contacts (4) being crimped to respective electrical cables (8) and adapted to be accommodated in said contact housings (20) of the connector body (2); and locking means (5) adapted to be fixed to said connector body (2) after insertion of the contacts (4) into the contact housings (20), said locking means (5) comprising stop means (55) which protrude into said contact housings (20) so as to prevent said contacts (4) from coming out of their housings (20), wherein said stop means (55) of the locking means (5) are substantially semi-cylindrical in shape, so that their bottom end abuts against the edge of the top end of the respective contact (4) disposed in the contact housing (20).

12. An electrical connector element (1) comprising:

a connector body (2) in which contact housings (20) are formed;

electrical contacts (4) crimped to respective electrical cables (8) and adapted to be accommodated in said contact housings (20) of the connector body (2); and locking means (5) adapted to be fixed to said connector body (2) after insertion of the contacts (4), said locking means (5) comprising stop means (55) which protrude into said contact housings (20) so as to prevent said contacts (4) from coming out of their housings (20), wherein said locking means are made in a single piece by injection moulding of plastic material, and said locking means (5) are fixed in said connector body (2) by locking keys (7).

13. A connector element according to claim 12, wherein said locking means (5) are removably fixed in said connector body (2).

14. An electrical connector element (1) comprising:

a connector body (2) in which contact housings (20) are formed;

electrical contacts (4) crimped to respective electrical cables (8) and adapted to be accommodated in said contact housings (20) of the connector body (2); and locking means (5) adapted to be fixed to said connector body (2) after insertion of the contacts (4), said locking means (5) comprising stop means (55) which protrude into said contact housings (20) so as to prevent said contacts (4) from coming out of their housings (20), wherein said locking means are made in a single piece by injection moulding of plastic material, and said stop means (55) of the locking means (5) are substantially semi-cylindrical in shape, so that their bottom end abuts against the edge of the top end of the respective contact (4) disposed in the contact housing (20).

* * * * *